US010632748B2

(12) United States Patent
Kato et al.

(10) Patent No.: US 10,632,748 B2
(45) Date of Patent: Apr. 28, 2020

(54) LIQUID EJECTION HEAD

(71) Applicant: CANON KABUSHIKI KAISHA, Tokyo (JP)

(72) Inventors: Maki Kato, Fuchu (JP); Yoshinori Misumi, Tokyo (JP); Takahiro Matsui, Yokohama (JP); Yuzuru Ishida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/277,747

(22) Filed: Feb. 15, 2019

(65) Prior Publication Data

US 2019/0255850 A1 Aug. 22, 2019

(30) Foreign Application Priority Data

Feb. 22, 2018 (JP) ..... 2018-030194

(51) Int. Cl.
*B41J 2/14* (2006.01)
*H01H 85/02* (2006.01)

(52) U.S. Cl.
CPC ..... *B41J 2/14129* (2013.01); *B41J 2/14072* (2013.01); *H01H 85/0241* (2013.01)

(58) Field of Classification Search
CPC ..... B41J 2/14129; B41J 2/14072; H01H 85/0241
See application file for complete search history.

(56) References Cited

U.S. PATENT DOCUMENTS

2004/0085405 A1* 5/2004 Baek ..... B41J 2/14072 347/59

FOREIGN PATENT DOCUMENTS

JP 2014-124920 A 7/2014

OTHER PUBLICATIONS

IP.com search (Year: 2020).*

* cited by examiner

*Primary Examiner* — Lisa Solomon
(74) *Attorney, Agent, or Firm* — Canon U.S.A., Inc. I.P. Division

(57) ABSTRACT

A liquid ejection head includes: a substrate for the liquid ejection head that includes a heating resistance element, a covering portion that covers the heating resistance element, and a fuse part that electrically connects the covering portion and a common wiring to each other; and a flow path forming member. The flow path forming member is provided with a through-opening or a concave portion that is concave from a surface of the flow path forming member on a side of the substrate for the liquid ejection head, at a position that overlaps at least a part of the fuse part.

10 Claims, 10 Drawing Sheets

LIQUID EJECTION HEAD

BACKGROUND OF THE INVENTION

Field of the Invention

The present disclosure relates to a liquid ejection head that ejects a liquid.

Description of the Related Art

Currently, there is widely employed a liquid ejecting apparatus equipped with a liquid ejection head that causes a heating resistance element to be energized, thereby, heating a liquid inside a liquid chamber, causing film boiling to the liquid, and ejecting liquid droplets from an ejection orifice by using foaming energy of the film boiling. In a case where recording is performed by the liquid ejecting apparatus, a physical action such as an impact due to cavitation occurring when the liquid foams, contracts, and is defoamed in a region on the heating resistance element may act on the region on the heating resistance element. In addition, since the temperature of the heating resistance element increases when the liquid is ejected, a chemical action such as thermal decomposition of components of the liquid and attaching, fixing, and accumulating of the components to a surface of the heating resistance element may act on the region on the heating resistance element. In order to protect the heating resistance element from the physical action or the chemical action on the heating resistance element, a protective layer is disposed on the heating resistance element so as to function as a covering portion that covers the heating resistance element.

In general, the protective layer is disposed at a position that is in contact with the liquid. Hence, when electricity flows to the protective layer, an electrochemical reaction occurs between the protective layer and the liquid, and thus there is a concern that a function as the protective layer will be impaired. Therefore, an insulating layer is disposed between the heating resistance element and the protective layer such that a part of electricity that is supplied to the heating resistance element does not flow to the protective layer.

Incidentally, there is a possibility that a function of the insulating layer will be impaired due to any cause (accidental malfunction), and electric conduction will occur, in which electricity flows directly from the heating resistance element or a wiring to the protective layer. In a case where a part of electricity that is supplied to the heating resistance element flows to the protective layer, the electrochemical reaction occurs between the protective layer and the liquid, and thus there is a possibility that the protective layer will be subjected to a property change. When the protective layer is subjected to the property change, there is a concern that durability of the protective layer will be degraded. Further, in a case where protective layers that cover different heating resistance elements, respectively, are electrically connected to each other, there is a concern that a current will flow to another protective layer separate from the protective layer in which electric conduction to the heating resistance element occurs, and an influence of the property change increases in the liquid ejection head.

In order to prevent the influence from increasing, it is effective to use a configuration in which a plurality of protective layers are individually separated from each other; however, when there is a defect in the insulating layer in a manufacturing process of the liquid ejection head, the heating resistance element and the protective layer are also likely to be electrically conducted. Therefore, it is preferable to inspect an insulation property of the insulating layer in the manufacturing process, and thus it is preferable to employ a configuration in which the plurality of protective layers are electrically connected to each other.

Japanese Patent Application Laid-Open No. 2014-124920 discloses a configuration in which each protective layer is connected via a fuse part to a common wiring that is electrically connected to a plurality of the protective layers. In a case where the above-described electric conduction occurs in the configuration such that a current flows to one protective layer, the fuse part is cut by the current, and thereby the electrical connection to the other protective layers is cut. Consequently, it is possible to suppress an increase in influence of a property change of the protective layer.

SUMMARY OF THE INVENTION

A liquid ejection head includes: a substrate for the liquid ejection head that includes a base that is provided with a surface on which a first heating resistance element and a second heating resistance element that generate heat for ejecting a liquid are provided, a first covering portion that has conductivity and covers the first heating resistance element, a second covering portion that has conductivity and covers the second heating resistance element, an insulating layer that is disposed between the first heating resistance element and the first covering portion and between the second heating resistance element and the second covering portion, a common wiring that is electrically connected to the first covering portion and the second covering portion, and a fuse part that is cut due to heat generation, the fuse part being provided on a side of the base on which the first covering portion is provided and electrically connecting the first covering portion and the common wiring to each other; and a flow path forming member that is provided on the substrate for the liquid ejection head on a side of the first covering portion and has a wall which forms a flow path. The flow path forming member is provided with a through-opening or a concave portion that is concave from a surface of the flow path forming member on a side of the substrate for the liquid ejection head, at a position that overlaps at least a part of the fuse part in a direction orthogonal to the surface.

In a case of using a fuse part as in Japanese Patent Application Laid-Open No. 2014-124920, in order to suppress an increase in influence of a property change of a covering portion, there is a demand for a configuration in which the fuse part is easily cut.

Further features of the present disclosure will become apparent from the following description of exemplary embodiments with reference to the attached drawings.

DESCRIPTION OF THE EMBODIMENTS

An aspect of the present disclosure is to improve a cutting property of a fuse part and to further suppress an increase in influence of a property change of a covering portion in a case where a heating resistance element and the covering portion are electrically conducted.

According to another aspect of the present disclosure, it is possible to improve the cutting property of the fuse part and to further suppress the increase in influence of the property change of the covering portion in the case where the heating resistance element and the covering portion are electrically conducted.

First Embodiment

Configuration of Ink Jet Head

Figure 1:
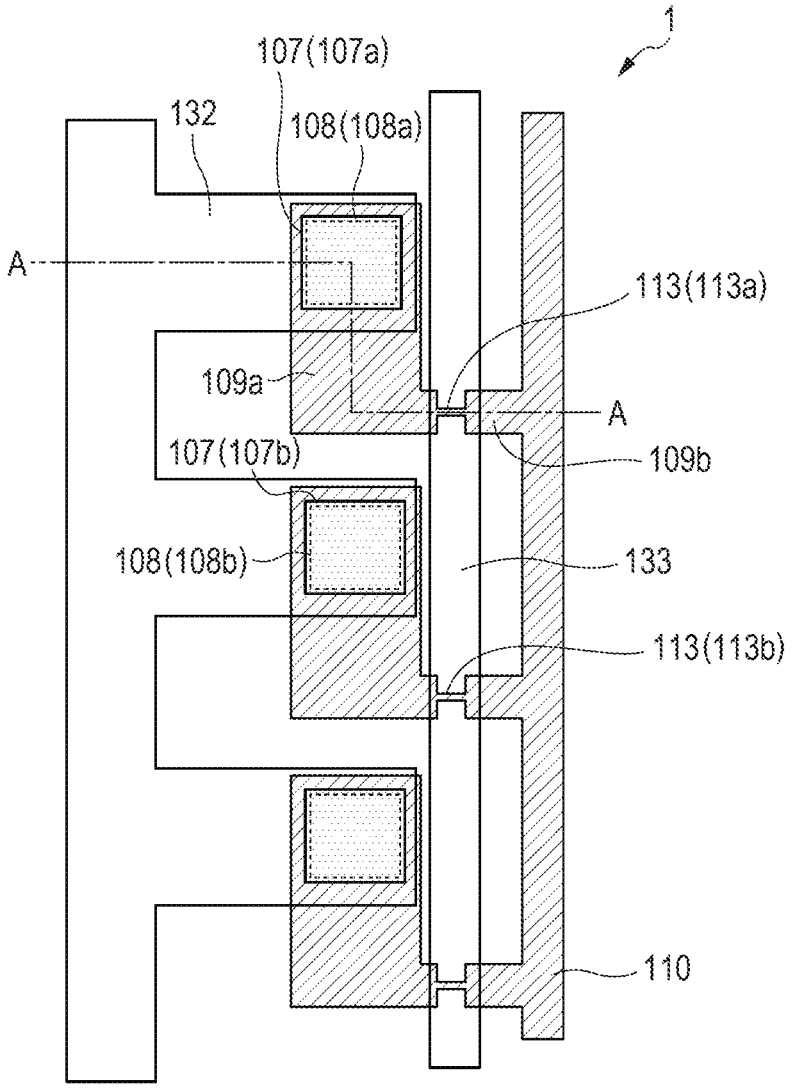
FIG. 1 is a plan view of a region including a heating resistance element and a fuse part of an ink jet head according to a first embodiment.

FIG. 1 is a plan view schematically illustrating a region including a heating resistance element 108 and a fuse part 113 of an ink jet head 1 as a liquid ejection head according to a first embodiment. In addition, FIG. 2A illustrates a section of the ink jet head 1 taken along line A-A in FIG. 1.

Figure 2A:
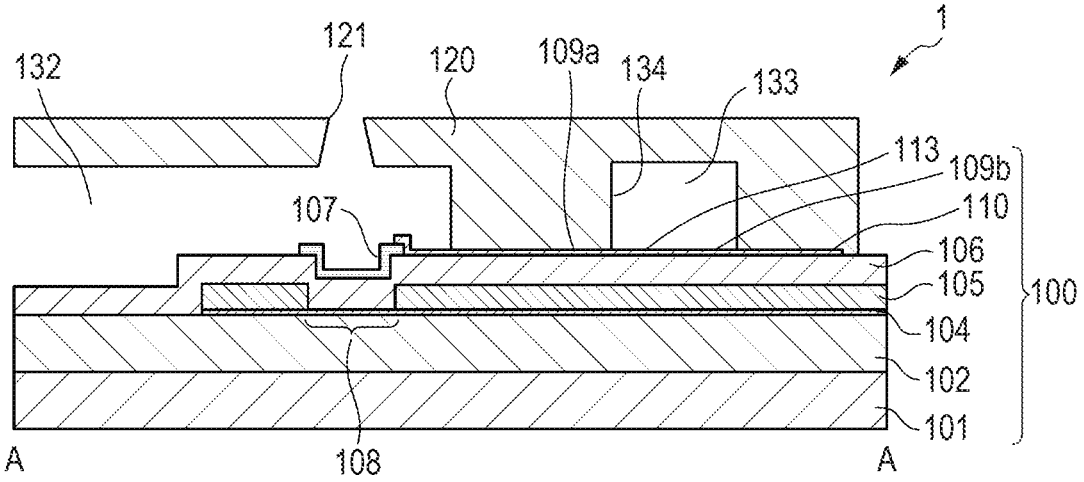
FIG. 2A is a sectional view of the ink jet head according to the first embodiment.

As illustrated in FIG. 2A, a plurality of layers are stacked on a base 101 formed of silicon such that a substrate for the inkjet head 100 is formed as a substrate for the liquid ejection head. In the embodiment, a heat accumulating layer 102 formed of a thermally oxidized film, a SiO film, a SiN film, or the like on the base 101. In addition, a heating resistance layer 104 that is formed of TaSiN is disposed on the heat accumulating layer 102, and an electrode wiring layer 105 as a wiring formed of a metal material such as Al, Al—Si, Al—Cu, or the like is disposed on the heating resistance layer 104. An insulating protection layer 106 (insulating layer) is disposed on the electrode wiring layer 105. The insulating protection layer 106 is provided on the heating resistance layer 104 and the electrode wiring layer 105 so as to cover the layers. The insulating protection layer 106 is formed of a SiO film, a SiN film, or the like.

An upper protective layer 107 (covering portion) is disposed on the insulating protection layer 106. The upper protective layer 107 protects a surface of the heating resistance element 108 from a chemical or physical impact due to heat generation by the heating resistance element 108. In the embodiment, the upper protective layer 107 is formed of the platinum group such as iridium (Ir) or ruthenium (Ru), tantalum (Ta), a laminating film thereof, or the like. In addition, the upper protective layer 107 formed of the materials has conductivity. When ink is ejected, a surface of the upper protective layer 107 is in contact with the ink, a hostile environment is formed, in which a temperature of the ink increases instantaneously on an upper part of the upper protective layer 107, foams, and is defoamed, and thereby cavitation occurs. Therefore, in the embodiment, the upper protective layer 107 formed of a material having high corrosion resistance and high reliability is formed at a position corresponding to the heating resistance element 108.

Since the upper protective layer 107 aims to secure a long service lift even when the surface thereof receives a chemical influence or a physical impact such as cavitation, it is preferable that the upper protective layer is formed to be relatively thick, whereas ejection energy increases. Therefore, regarding a balance between a thickness and energy saving, it is preferable that the upper protective layer is provided to have a thickness of about 40 to 300 nm.

The electrode wiring layer 105 is partially removed, and thus the heating resistance layer 104 corresponding to the removed portion functions as the heating resistance element 108. The electrode wiring layer 105 is configured to be connected to an external power supply terminal without a drive element circuit (not illustrated) and to be capable of receiving power supply from the outside. The embodiment employs a configuration in which the electrode wiring layer 105 is disposed on the heating resistance layer 104; however, the disclosure is not limited thereto. A configuration may be employed, in which the electrode wiring layer 105 is formed on the base 101 or the thermally oxidized film 102, the electrode wiring layer 105 is partially removed such that a gap is formed, and the heating resistance layer 104 is disposed on the electrode wiring layer 105. In addition, a configuration may be employed, in which the electrode wiring layer 105, which is embedded in the heat accumulating layer 102, and the heating resistance layer 104, which is provided on a surface of the heat accumulating layer 102, are formed of tungsten and are connected to each other with a plug, and thereby the heating resistance layer 104 functions as the heating resistance element 108.

A flow path forming member 120 for forming a liquid chamber 132 (flow path), in which a liquid to be ejected is accumulated, is joined to the substrate for the ink jet head 100 on a side of the upper protective layer 107. The flow path forming member 120 is formed of a resin material or the like. In addition, an ejection orifice 121 is formed at a position corresponding to the heating resistance element 108 of the flow path forming member 120.

As illustrated in FIG. 1, a plurality of heating resistance elements 108 including a first heating resistance element 108*a* and a second heating resistance element 108*b* are provided in the substrate for the ink jet head 100. In addition, a plurality of the upper protective layers 107 are provided to correspond to the plurality of heating resistance elements 108. In other words, an upper protective layer 107*a* (first covering portion) that covers the first heating resistance element 108*a* and an upper protective layer 107*b* (second covering portion) that covers the second heating resistance element 108*b* are provided. The upper protective layer 107 may be provided to cover the plurality of heating resistance elements 108.

Individual wirings 109 (109*a* and 109*b*) are connected to the upper protective layer 107 formed inside the liquid chamber 132. The individual wirings 109 are connected to the common wiring 110, and thus the plurality of upper protective layers 107 are electrically connected to each other via the individual wirings 109 connected to the plurality of upper protective layers 107, respectively, and the common wiring 110. In the embodiment, the common wiring 110 is formed to be parallel to an arrangement direction of the plurality of heating resistance elements 108 (arrangement direction of a plurality of ejection orifices 121). The individual wirings 109 or the common wiring 110 can be formed of any one of Ta, Ir, or Ru, alloy containing any one of Ta, Ir, or Ru, or a laminating layer thereof. In addition, the individual wirings 109 or the common wiring 110 may be formed of the same material as that of the upper protective layer 107.

In addition, the fuse part 113 is formed between an individual wiring 109*a* connected to the side of the upper protective layer 107 and an individual wiring 109*b* connected to the side of the common wiring 110. The fuse part 113 is formed to have a width smaller than a width of the individual wirings 109*a* and 109*b* and generates heat so as to be easily cut when the current flow. In the embodiment, the fuse part 113 is formed to have the same thickness as that of the individual wirings 109 or the common wiring 110; however, in order to improve the cutting property, the fuse part may be formed to be thinner than the individual wirings 109 or the common wiring 110. In addition, in the embodiment, the fuse part 113 is formed of the same material (for example, Ta) as that of the individual wirings 109 and the common wiring 110; however, the fuse part may be formed of a different material from that. The fuse part 113 can be formed of any one of Ta, Ir, or Ru, alloy containing any one of Ta, Ir, or Ru, or a laminating layer thereof.

The flow path forming member 120 is provided with a concave portion 134 that is concave from a surface of the flow path forming member 120 on the side of the substrate for the ink jet head 100, at a position that overlaps the fuse part 113 in a stacking direction of the ink jet head 1. In other words, the concave portion 134 and the fuse part 113 overlap each other when viewed in a direction orthogonal to a surface of the base 101 on which the heating resistance element 108 is provided. A space 133 that is surrounded by the concave portion 134 and the substrate for the ink jet head 100 is filled with a gas such as air. As illustrated in FIG. 1, the space 133 is provided to overlap a plurality of fuse parts 113 (a first fuse part 113*a* and a second fuse part 113*b*).

Circuit Configuration of Ink Jet Head

Figure 3A:
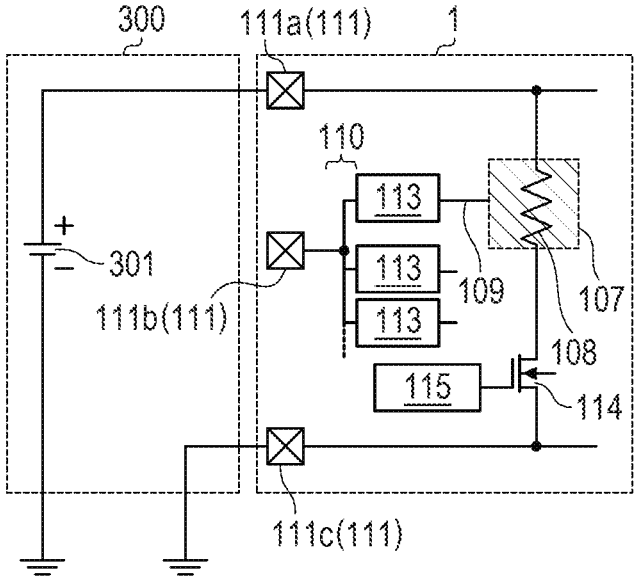
FIG. 3A is a circuit diagram of the ink jet head and an ink jet recording apparatus main body according to the first embodiment.
Figure 3B:
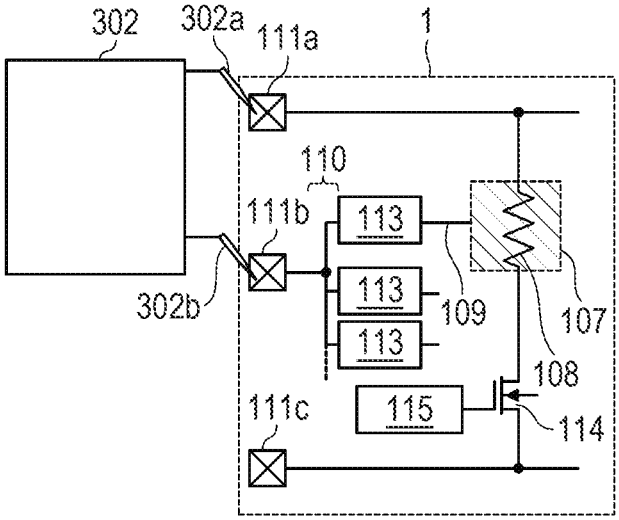
FIG. 3B is a circuit diagram of the ink jet head and the ink jet recording apparatus main body according to the first embodiment.
Figure 3C:
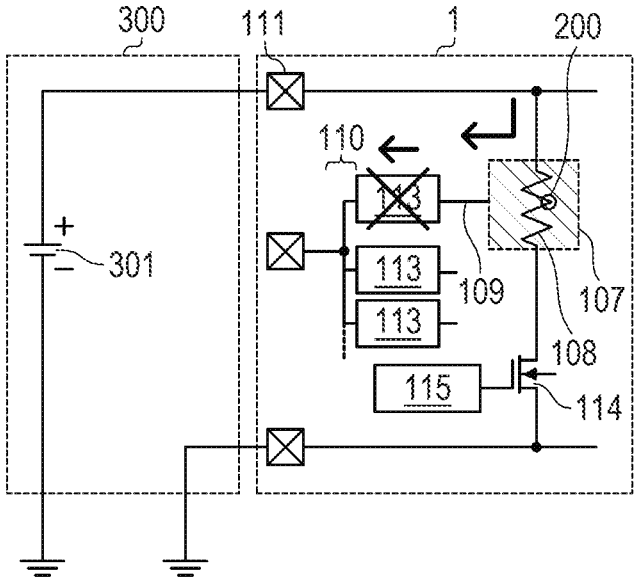
FIG. 3C is a circuit diagram of the ink jet head and an ink jet recording apparatus main body according to the first embodiment.

FIGS. 3A to 3C illustrate circuit diagrams of the ink jet head 1 in the embodiment and an ink jet recording apparatus main body 300 as a liquid ejecting apparatus equipped with the ink jet head 1.

FIG. 3A is a circuit diagram of a state in which recording is normally performed. The plurality of heating resistance elements 108 are selected by a switching transistor 114 and a selection circuit 115, and a voltage is applied from a power supply 301 so as to drive the heating resistance elements. The power supply 301 has a voltage of 20 to 30 V, for example. The embodiment employs the power supply 301 having a voltage of 24 V. In such a configuration, it is possible to supply electric power to the heating resistance element 108 from the power supply 301 at a predetermined timing, and thus it is possible to eject an ink droplet from the ejection orifice at a predetermined timing.

Since the insulating protection layer 106 that functions as the insulating layer is disposed between the heating resistance element 108 and the upper protective layer 107, the heating resistance element 108 and the upper protective layer 107 are not electrically connected to each other. In addition, the upper protective layer 107 is connected to the common wiring 110 via the individual wirings 109 and the fuse part 113, and thus the common wiring 110 is connected to an electrode 111*b* that is capable of being connected to the outside.

FIG. 3B is a circuit diagram illustrating a state in which a test of an insulation property of the insulating protection layer 106 that functions as the insulating layer is conducted. The test of the insulation property of the insulating protection layer 106 is conducted in a state such as a state before shipment in which there is no ink in the ink jet head 1. A measurement device 302 for checking the insulation property of the insulating protection layer 106 is disposed to be connected to an electrode 111*a* connected to a wiring for supplying electric power to the heating resistance element 108 and an electrode 111*b* connected to a wiring connected to the common wiring 110. The measurement device 302 includes probe pins (needles) 302*a* and 302*b*. The probe pins 302*a* and 302*b* are connected to the electrodes 111*a* and 111*b*, and thereby it is possible to detect a current in a case where the current flows between the electrodes. In a case where the current is not detected between the electrodes 111*a* and 111*b*, it is checked that the insulating protection layer 106 reliably has the insulation property. In addition, in a case where the flow of the current between the electrodes 111*a* and 111*b* is detected, the insulation property of the insulating protection layer 106 is impaired, and thus it is detected that a part of the current that is supplied to the heating resistance element 108 flows to the upper protective layer 107.

In addition, in the ink jet head 1, an electrode 111*c* is provided on a wiring extending from the switching transistor 114. The probe pins 302*a* and 302*b* are connected to the electrode 111*a* and the electrode 111*c*, respectively, and whether the current flows between the electrodes is detected. In this manner, it is possible to detect whether the heating resistance element 108 or the switching transistor 114 normally function. When such test is conducted, a voltage equal to or higher than an actually applied voltage is applied between the upper protective layer 107 and the heating resistance element 108 or the electrode wiring layer 105 such that a current that flows therebetween is measured. Since the upper protective layer 107 is not in contact with the ink when the inspection is conducted, an electrochemical reaction such as anodization does not occur in the upper protective layer 107 via the ink even when the voltage is applied. Therefore, it is possible to reliably measure the current related to presence and absence of a leak current between the upper protective layer 107 and the heating resistance element 108 or the electrode wiring layer 105.

The anodization of the upper protective layer 107 due to the flow of the current to the upper protective layer 107 often occurs when a pinhole or the like is formed, and thus the insulating protection layer 106 does not have the insulation property during the manufacturing of the ink jet head 1. Therefore, it is preferable to perform the checking of whether the insulating protection layer 106 has the insulation property, during the manufacturing. The test for performing the checking is suitably conducted in a stage after the upper protective layer 107 is formed and, then, the electrode 111 for applying electricity is formed.

In a process of performing the recording, there is a possibility that a current will flow between the heating resistance layer 104 or the electrode wiring layer 105 and the upper protective layer 107 and, thus, the electric conduction occurs. FIG. 3C illustrates a circuit diagram in a case where the electric conduction occurs.

For example, when the heating resistance element 108 is damaged, the insulating protection layer 106 is broken by an influence thereof in some cases. In this case, there is a possibility that a part of each of the heating resistance layer 104 and the upper protective layer 107 will be melted and will be in direct contact with each other such that electric conduction 200 occurs, and the current flows to the upper protective layer 107. When the upper protective layer 107 is formed of Ta, the electrochemical reaction occurs between the upper protective layer 107 and the ink such that the anodization occurs. Oxidized Ta is likely to be dissolved in the ink. Therefore, when the anodization proceeds, there is a concern that the service life of the upper protective layer 107 will be shortened. In addition, in a case where the upper protective layer 107 is made of Ir or Ru, the upper protective layer 107 is eluted in the ink due to the electrochemical reaction between the upper protective layer 107 and the ink, and thus there is a concern that the durability of the upper protective layer 107 will be degraded.

When the ink is stored inside the liquid chamber 132, and the heating resistance element 108 is energized to be driven, a potential of the ink is lower than a driving potential of the heating resistance element 108. Hence, when the electric conduction occurs such that the current flows to the upper protective layer 107, the electrochemical reaction occurs easily between the upper protective layer 107 and the ink. In addition, when the electric conduction occurs, the current is likely to flow to the other upper protective layer 107, in which the electric conduction does not occur, through the common wiring 110, and thus there is a possibility that degradation of the durability of the upper protective layer 107 will act on a wide range of the ink jet head 1.

In the embodiment, the fuse part 113 is formed between the upper protective layer 107 and the common wiring 110. Hence, when electric conduction occurs between the heating resistance layer 104 or the electrode wiring layer 105 and the upper protective layer 107 such that the current flows to the upper protective layer 107, the current also flows to the fuse part 113. A temperature of the fuse part 113 increases rapidly due to Joule heat of the current flowing to the fuse part 113. Consequently, the fuse part 113 is oxidized and melted such that the fuse part 113 is cut, and thus it is possible to disconnect electrical connection between the upper protective layer 107 and the common wiring 110. Consequently, it is possible to suppress an increase in influence in a wide range due to the electric conduction.

In addition, in the embodiment, since the space 133 that contains the gas such as the air is provided on an upper side of the fuse part 113, and thus it is difficult for the Joule heat to be released, it is possible to easily cut the fuse part 113. Consequently, it is possible to improve the cutting property of the fuse part 113 and to further suppress the increase in influence of the property change of the upper protective layer 107 in the case where the heating resistance element 108 and the upper protective layer 107 are electrically conducted.

It is preferable that the entire fuse part 113 is positioned on an inner side of the concave portion 134; however, when at least a part of the fuse part 113 is positioned on the inner side of the concave portion 134, it is possible to suppress releasing of the heat and to obtain an effect of improvement in cutting property.

Further, since the space is formed on the upper side of the fuse part 113, it is also possible to suppress a concern that a melted material after the fuse part 113 is broken will be again attached such that electric conduction will occur again.

In addition, there is also a concern that the insulating protection layer 106 on the lower side of the fuse part will be damaged by the impact of breaking of the fuse part 113, the ink will infiltrate from the damaged portion, and the electrode wiring layer 105, which is covered with the insulating protection layer 106 into which the ink infiltrates, will be corroded. However, in the embodiment, since the fuse part 113 is positioned in the space 133, into which the ink is unlikely to infiltrate, the space being provided separately from the liquid chamber 132, it is possible to suppress a concern that the ink will infiltrate into the periphery of the fuse part 113.

Figure 2B:
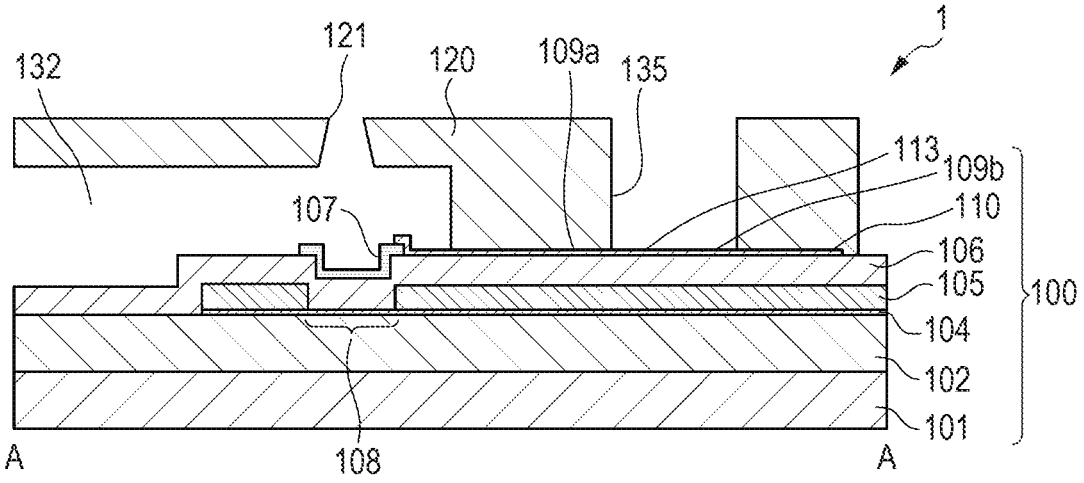
FIG. 2B is a sectional view of the ink jet head according to the first embodiment.

Instead of the concave portion 134 of the flow path forming member 120, a through-opening 135 that penetrates the flow path forming member 120 at the position that overlaps at least a part of the fuse part 113 may be provided (FIG. 2B). In this case, it is also possible to obtain the effect of the improvement in the cutting property of the fuse part 113 or suppression of a reoccurrence of electric conduction. It is more preferable to form the through-opening 135 than the concave portion 134 in that the manufacturing becomes easy. Although the example in which the concave portion 134 is provided to overlap the plurality of fuse parts 113 has been described, the present embodiment is not limited thereto. The concave portion 134 and the through-opening 135 may be provided to overlap each of the plurality of fuse parts 113. That is, a first concave portion 134 or a first through-opening 135 that overlaps the first fuse part 113*a* may be provided, and a second concave portion 134 or a second through-opening 135 that overlaps the second fuse part 113*b* may be provided.

In addition, the fuse part 113 provided at the position that overlaps the concave portion 134 or the through-opening 135 may be covered with a thin film. In a case where the fuse part 113 is configured to be exposed, the cutting property increases; however, a film reduction of the insulating protection layer 106 is rapid depending on a type of ink in some cases, and thus it is possible to suppress the occurrence of ink infiltration when the fuse part 113 is covered with a film having high ink resistance. In this case, it is preferable to provide a thin film having a thickness to the extent that the cutting property is not impaired.

Even in a case where the electric conduction of the upper protective layer 107 occurs, the heating resistance element 108 covered with the other upper protective layer 107 can normally perform ejection of the ink. Therefore, it is possible to suppress a degradation of a quality of a recording image due to the electric conduction. In addition, it is possible to interpolate the ejection by the heating resistance element 108, in which the electric conduction with the upper protective layer 107 occurs, by using another heating resistance element 108 on the periphery. Hence, it is possible to suppress an exchange frequency of the ink jet head 1 and to elongate the service life of the ink jet head 1. Consequently, it is possible to reduce operation costs of the ink jet recording apparatus.

Manufacturing Process of Ink Jet Head

A manufacturing process of the ink jet head according to the embodiment is described. FIGS. 4A to 4E are partial sectional views for illustrating the manufacturing process of the substrate for the ink jet head 100 according to the embodiment.

In general, in the manufacturing process of the ink jet head 1, in a state in which a drive circuit is installed in the base 101 formed of Si in advance, layers are stacked on the base 101 such that the ink jet head 1 is manufactured. A semiconductor element or the like such as the switching transistor 114 for selectively driving the heating resistance elements 108 is installed as the drive circuit in the base 101 in advance, and the layers are stacked thereon such that the ink jet head 1 is formed. However, the drive circuit or the like, which is disposed in advance for simplification is not illustrated, just the base 101 is illustrated in FIGS. 4A to 4E.

First, the heat accumulating layer 102 formed of a thermally oxidized film made of SiO2 is formed as a lower layer of the heating resistance layer 104 on the base 101, through a thermal oxidation method, a sputtering method, a CVD method, or the like. It is possible to form the heat accumulating layer 102 in a manufacturing process of the drive circuit, with respect to the base 101 in which the drive circuit is installed in advance.

Figure 4A:
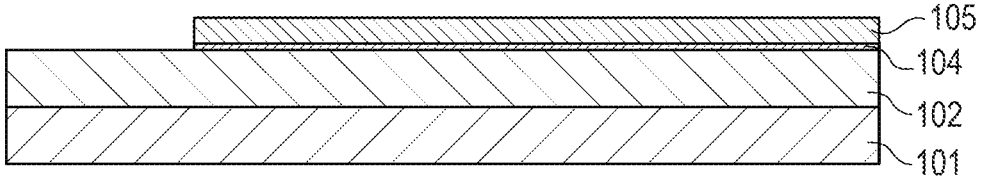
FIG. 4A is a partial sectional view for illustrating a manufacturing process of a substrate for the ink jet head according to the first embodiment.

Next, the heating resistance layer 104 made of TaSiN or the like is formed on the heat accumulating layer 102 so as to have a thickness of about 50 nm by reactive sputtering. Subsequently, an Al layer is formed on the heating resistance layer 104 so as to have a thickness of about 300 nm through sputtering, and thereby the electrode wiring layer 105 is formed. Dry etching is performed on the heating resistance layer 104 and the electrode wiring layer 105 simultaneously by using a photolithography method, and an unnecessary portion of the heating resistance layer 104 and the electrode wiring layer 105 is removed (FIG. 4A). An example of the dry etching can include a reactive ion etching (RIE) method.

Figure 4B:
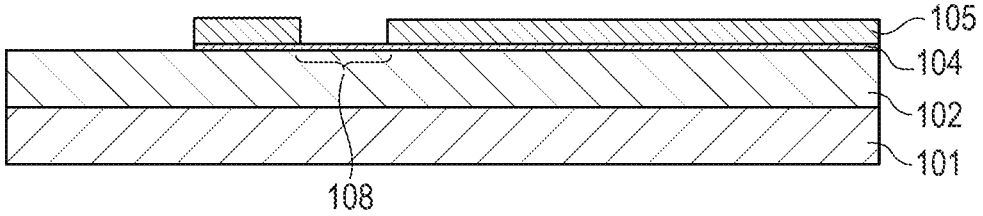
FIG. 4B is a partial sectional view for illustrating the manufacturing process of the substrate for the ink jet head according to the first embodiment.

Next, in order to form the heating resistance element 108, as illustrated in FIG. 4B, the electrode wiring layer 105 is partially removed through wet etching by using the photolithography method again, and the heating resistance layer 104 is exposed through the removed portion. A good coverage property is obtained by the insulating protection layer 106 that is formed later. Therefore, in this case, it is desirable that a partial removal of the electrode wiring layer 105 is performed through well-known wet etching by which an appropriate tapered shape is performed on an end portion of the electrode wiring layer 105.

Figure 4C:
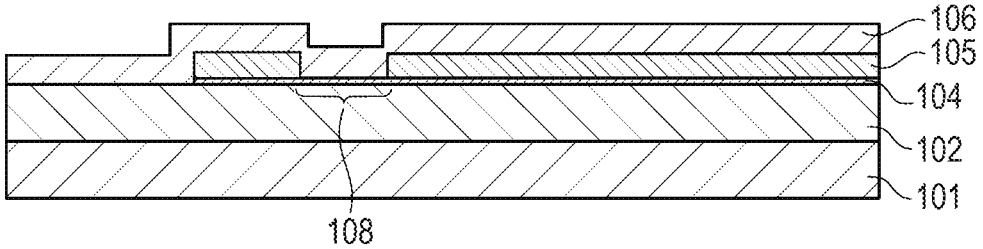
FIG. 4C is a partial sectional view for illustrating the manufacturing process of the substrate for the ink jet head according to the first embodiment.

Then, as illustrated in FIG. 4C, a SiN film is formed to have a thickness of about 100 nm as the insulating protection layer 106 by using a plasma CVD method.

Figure 4D:
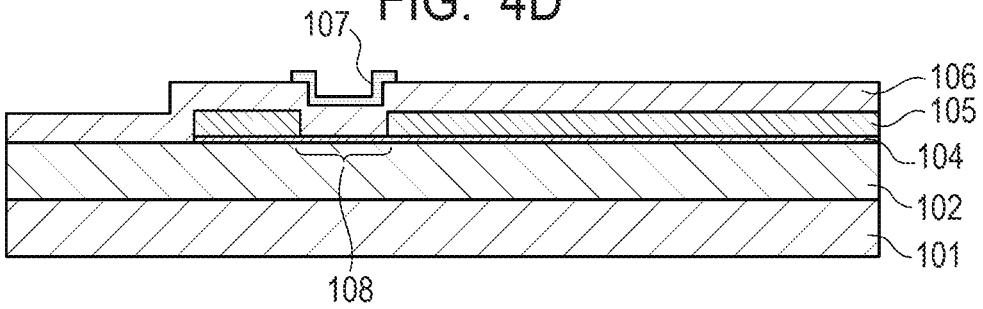
FIG. 4D is a partial sectional view for illustrating the manufacturing process of the substrate for the ink jet head according to the first embodiment.

Next, a layer formed of a platinum group is formed to have a thickness of about 100 nm as the upper protective layer 107 by sputtering on the insulating protection layer 106. Here, the upper protective layer 107 is formed of Ir or Ru. Next, the layer formed of the platinum group is partially removed into a shape as illustrated in FIG. 4D through the dry etching by using the photolithography method. Consequently, the upper protective layer 107 is formed in a region on the heating resistance element 108.

Figure 4E:
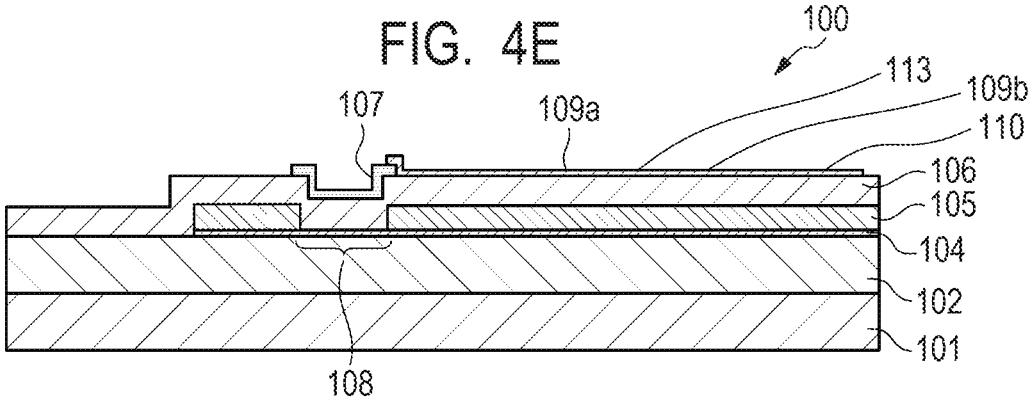
FIG. 4E is a partial sectional view for illustrating the manufacturing process of the substrate for the ink jet head according to the first embodiment.

Next, a Ta layer is formed to have a thickness of 100 nm by sputtering. In order to form the individual wirings 109 (109*a* and 109*b*), the fuse part 113, and the common wiring 110 having a planar shape illustrated in FIG. 1, the Ta layer is subjected to the dry etching by using the photolithography method (FIG. 4E). Consequently, the fuse part 113, the common wiring 110, the individual wiring 109*a* that connects the upper protective layer 107 and the fuse part 113 to each other, and the individual wiring 109*b* that connects the fuse part 113 and the common wiring 110 to each other are formed.

Next, in order to form the electrodes 111, the insulating protection layer 106 is partially removed through the dry etching by using the photolithography method, and the electrode wiring layer 105 is exposed through the removed portion (not illustrated).

Figure 5A:
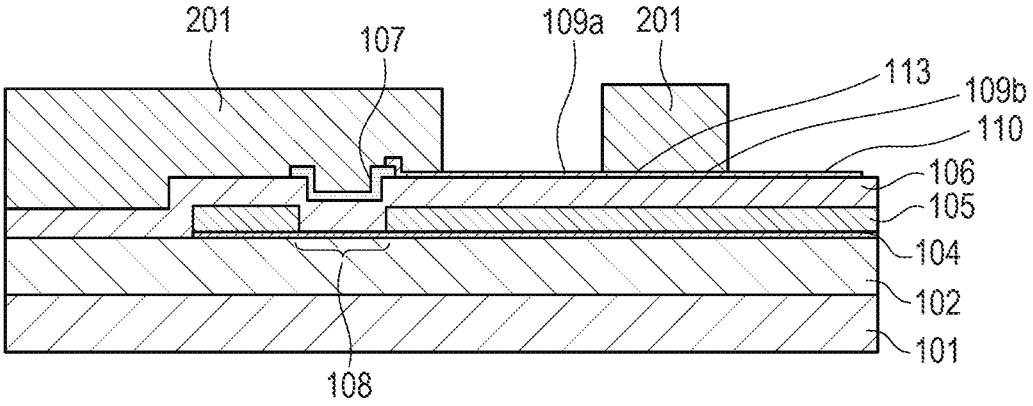
FIG. 5A is a partial sectional view for illustrating a manufacturing process of the ink jet head according to the first embodiment.
Figure 5B:
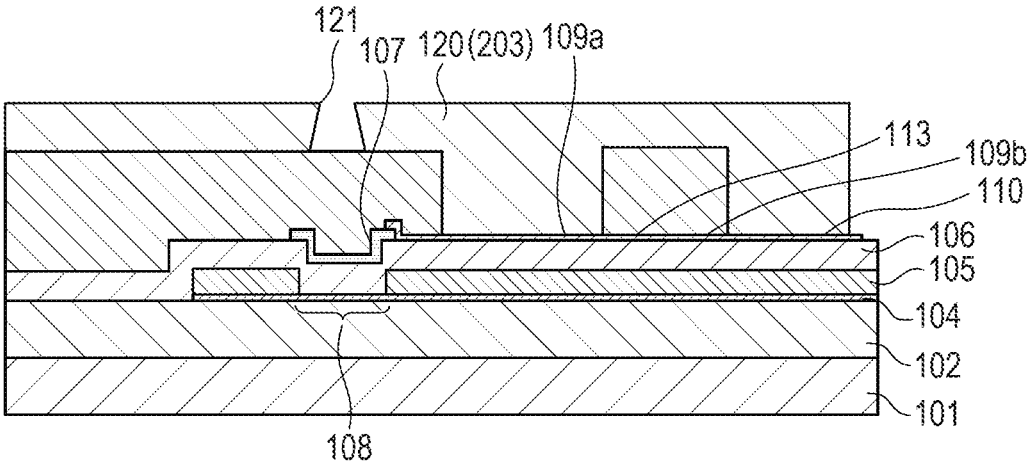
FIG. 5B is a partial sectional view for illustrating a manufacturing process of the ink jet head according to the first embodiment.
Figure 5C:
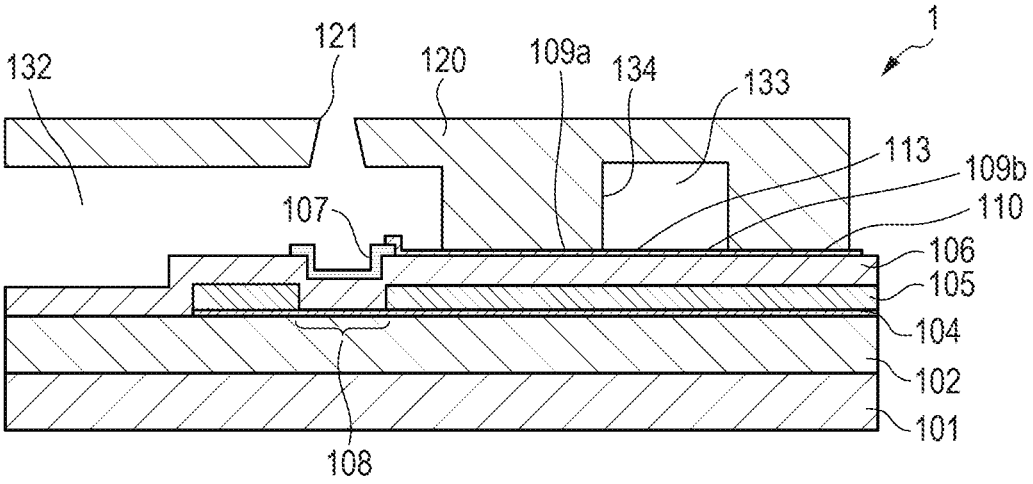
FIG. 5C is a partial sectional view for illustrating a manufacturing process of the ink jet head according to the first embodiment.

FIGS. 5A to 5C are partial sectional views for illustrating a process of manufacturing the ink jet head 1 by using the substrate 100.

First, in order to form the liquid chamber 132 or the space 133, a resist material is applied by a spin coating method such that a resist layer 201 is provided on a surface of the substrate for the ink jet head 100 on the side of the upper protective layer 107. The resist material is made of polymethyl isopropenyl ketone, for example, and functions as a positive resist. The resist layer 201 is formed by patterning into a shape corresponding to the liquid chamber 132 or the space 133 as illustrated in FIG. 5A, by using the photolithography technique. The liquid chamber 132 and the space 133 are formed by using the same resist layer 201, and thereby a load in the manufacturing process is suppressed. The liquid chamber 132 and the space 133 are formed by using the same resist layer 201, thereby, having substantially the same height as each other.

Subsequently, in order to form the flow path forming member 120, a resin layer 203 that covers the resist layer 201 is formed. Before the resin layer 203 is formed, a silane coupling treatment may be appropriately performed in order to improve adhesiveness of the resin layer 203 to the substrate for the ink jet head 100. It is possible to appropriately select a coating method that is known in the related art so as to form the resin layer 203. Next, as illustrated in FIG. 5B, the ejection orifice 121 is formed on the resin layer 203 by using the photolithography technique. In addition, in this case, a pattern for removing the resist layer 201 is formed to form the space 133 (not illustrated). It is preferable that the pattern of the resin layer 203 for removing the resist layer 201 in order to form the space 133 is disposed at a position separated from the liquid chamber 132 in order to prevent ink infiltration.

Then, an ink supply port that penetrates the substrate for the ink jet head 100 is formed from a back surface of the substrate for the ink jet head 100 by using an anisotropic etching method, a sand blasting method, an anisotropic plasma etching method, or the like (not illustrated). Most preferably, the ink supply port can be formed by using a chemical silicon anisotropic etching method using tetramethylhydroxyamine (TMAH), NaOH, KOH, or the like. Subsequently, the entire surface is exposed to deep-UV light, development and drying are performed. In this manner, the dissolvable resist layer 201 is removed, and the liquid chamber 132 and the space 133 are formed (FIG. 5C).

The ink jet head 1 is manufactured through the following process.

Second Embodiment

Configuration of Ink Jet Head

Figure 6:
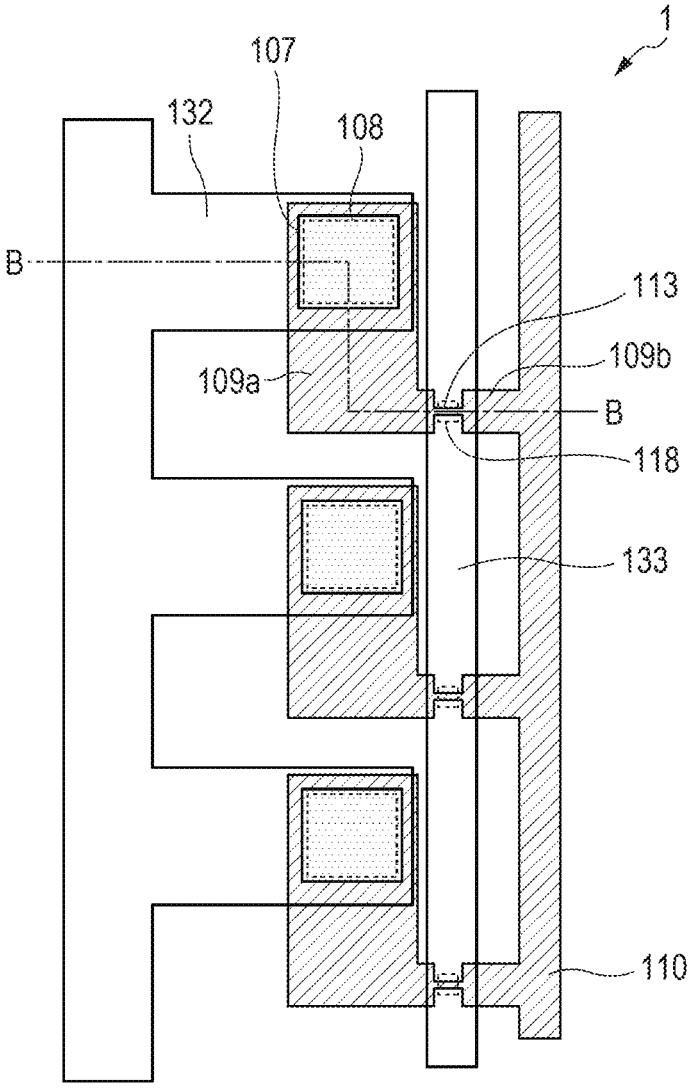
FIG. 6 is a plan view of a region including a heating resistance element and a fuse part of an ink jet head according to a second embodiment.
Figure 7:
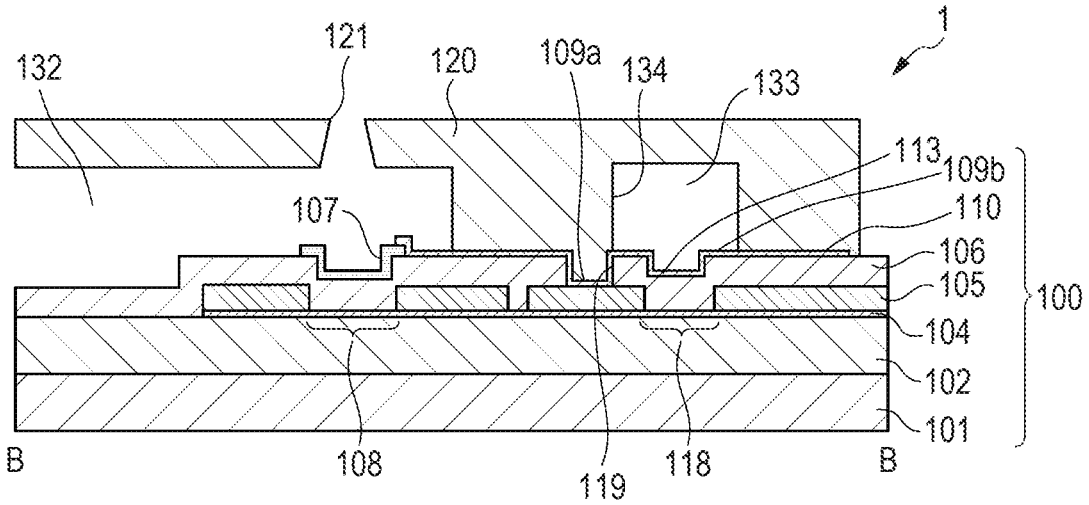
FIG. 7 is a sectional view of the ink jet head according to the second embodiment.

FIG. 6 is a plan view schematically illustrating a region including the heating resistance element 108 and the fuse part 113 of the ink jet head 1 according to a second embodiment. In addition, FIG. 7 illustrates a section of the ink jet head 1 taken along line B-B in FIG. 6.

In the embodiment, a heating resistance element 118 is formed as means for increasing a breaking speed below the fuse part 113 (side of the base 101) so as to generate heat in a case where electric conduction occurs between the heating resistance element 108 or the electrode wiring layer 105 and the upper protective layer 107. Consequently, it is possible to heat the fuse part 113, in addition to the Joule heat of the fuse part 113, and to promote an oxidation and melting reaction of the fuse part 113.

Below the fuse part 113, the electrode wiring layer 105 is partially removed such that heating resistance layer 104 is exposed at the lower layer, and thereby the heating resistance element 118 for heating the fuse part 113 is formed. The heating resistance element 118 is electrically connected to the upper protective layer 107 via the individual wiring 109*a* and the electrode wiring layer 105. When the upper protective layer 107 is electrically conducted, the current flows to the fuse part 113, and the current also flows to the heating resistance element 118 such that the heating resistance element 118 generates heat. The fuse part 113 is formed of any one of Ta, Ir, or Ru, alloy containing any one of Ta, Ir, or Ru, or a laminating layer thereof. The temperature of the materials increases due to the electric conduction of the upper protective layer 107, and the heating resistance element 118 disposed below the fuse part 113 generates heat. In this manner, it is possible to promote the oxidation and melting reaction of the fuse part and to shorten a time taken to reach electrical cutting.

Circuit Configuration of Ink Jet Head

Figure 8:
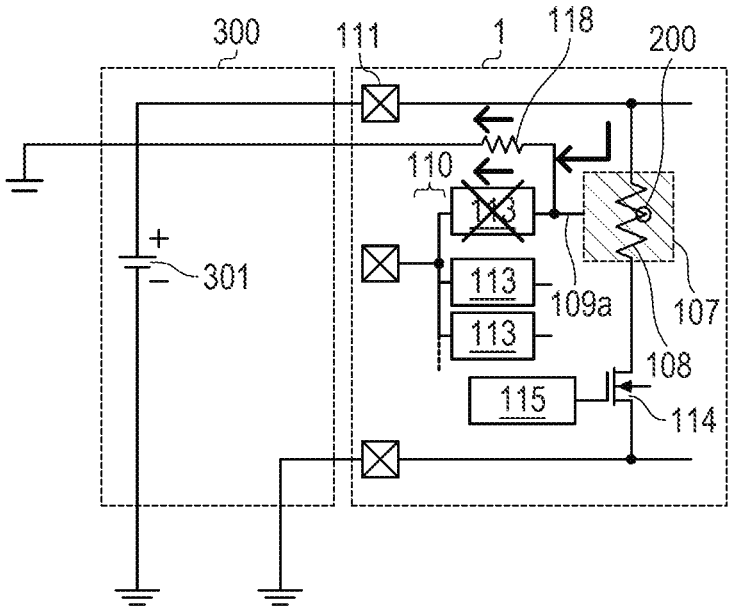
FIG. 8 is a circuit diagram of the ink jet head and an ink jet recording apparatus main body according to the second embodiment.

FIG. 8 is a circuit diagram of the ink jet head 1 in the embodiment and the ink jet recording apparatus main body 300 as the liquid ejecting apparatus equipped with the ink jet head 1. FIG. 8 is a circuit diagram in a case where electric conduction occurs between the heating resistance element 108 and the upper protective layer 107 in the embodiment. A part of the current that flows through the electrode wiring layer 105 flows toward the fuse part 113 and the heating resistance element 118 below the fuse part 113. The current is used to generate the Joule heat of the fuse part 113 and is used to cause the heating resistance element 118 to generate heat below the fuse part 113. Therefore, the temperature of the fuse part 113 is likely to increase, and thus it is possible to shorten a time taken to reach the electric breaking.

Manufacturing Process of Ink Jet Head

A manufacturing process of the ink jet head according to the embodiment is described.

First, the heat accumulating layer 102 formed of a thermally oxidized film made of SiO2 is formed as a lower layer of the heating resistance layer 104 on the base 101, through a thermal oxidation method, a sputtering method, a CVD method, or the like.

Next, the heating resistance layer 104 made of TaSiN or the like is formed on the heat accumulating layer 102 so as to have a thickness of about 50 nm by reactive sputtering. Subsequently, an Al layer is formed on the heating resistance layer 104 so as to have a thickness of about 300 nm through sputtering, and thereby the electrode wiring layer 105 is formed. The dry etching is performed on the heating resistance layer 104 and the electrode wiring layer 105 simultaneously by using the photolithography method. Consequently, a portion other than the heating resistance layer 104 and the electrode wiring layer 105 is removed, and thereby an unnecessary portion of the heating resistance layer 104 and the electrode wiring layer 105 is removed.

Next, the electrode wiring layer 105 is partially removed through the wet etching by using the photolithography method again, and the heating resistance layer 104 is exposed through the removed portion. Consequently, the heating resistance element 118 is formed to heat the heating resistance element 108 and the fuse part 113.

Then, a SiN film is formed to have a thickness of about 100 nm as the insulating protection layer 106 by using a plasma CVD method. Next, the insulating protection layer 106 is partially removed, and a through-hole 119 for connecting the electrode wiring layer 105 and the individual wiring 109*a*, which is formed later, to each other is formed.

Next, a layer formed of a platinum group is formed to have a thickness of about 100 nm as the upper protective layer 107 by sputtering on the insulating protection layer 106. Here, the upper protective layer 107 is formed of Ir or Ru. Next, the layer formed of the platinum group is partially removed through the dry etching by using the photolithography method. In this case, the upper protective layer 107 is formed in a region on the heating resistance element 108.

Next, a Ta layer is formed to have a thickness of 100 nm by sputtering. In order to form the individual wirings 109 (109*a* and 109*b*), the fuse part 113, and the common wiring 110 having a planar shape illustrated in FIG. 6, the Ta layer is subjected to the dry etching by using the photolithography method. Consequently, the fuse part 113, the common wiring 110, the individual wiring 109*a* that connects the upper protective layer 107 and the fuse part 113 to each other, and the individual wiring 109*b* that connects the fuse part 113 and the common wiring 110 to each other are formed. In addition, the individual wiring 109*a* is connected via the through-hole 119 to the electrode wiring layer 105 for supplying the current to the heating resistance element 118 for heating the fuse part 113.

Next, in order to form the electrodes 111, the insulating protection layer 106 is partially removed through the dry etching by using the photolithography method, and the electrode wiring layer 105 is exposed through the removed portion.

The manufacturing process thereafter of the ink jet head is the same as that of the above-described embodiment.

Third Embodiment

Configuration of Ink Jet Head

In the embodiment, in addition to suppression of the increase of the influence in the wide range by the electric conduction using the fuse part 113 as the above-described embodiment, a configuration is employed, in which it is possible to remove burnt deposits accumulated on a heat acting portion that is in contact with the ink.

Figure 9:
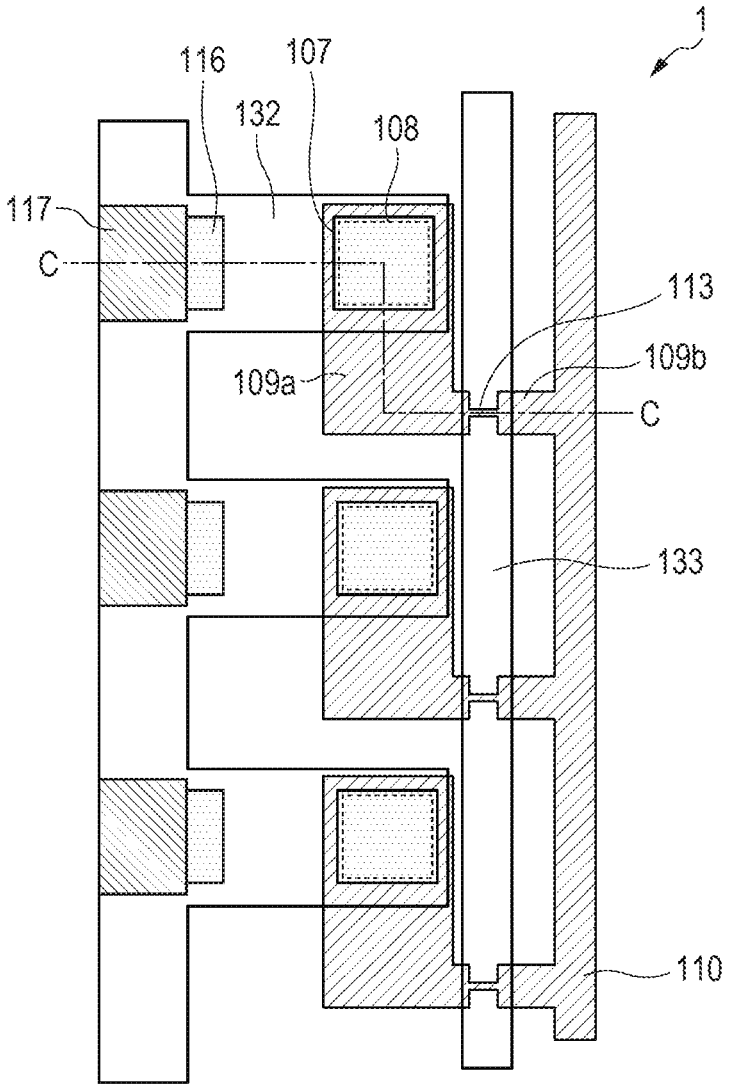
FIG. 9 is a plan view of a region including a heating resistance element and a fuse part of an ink jet head according to a third embodiment.
Figure 10:
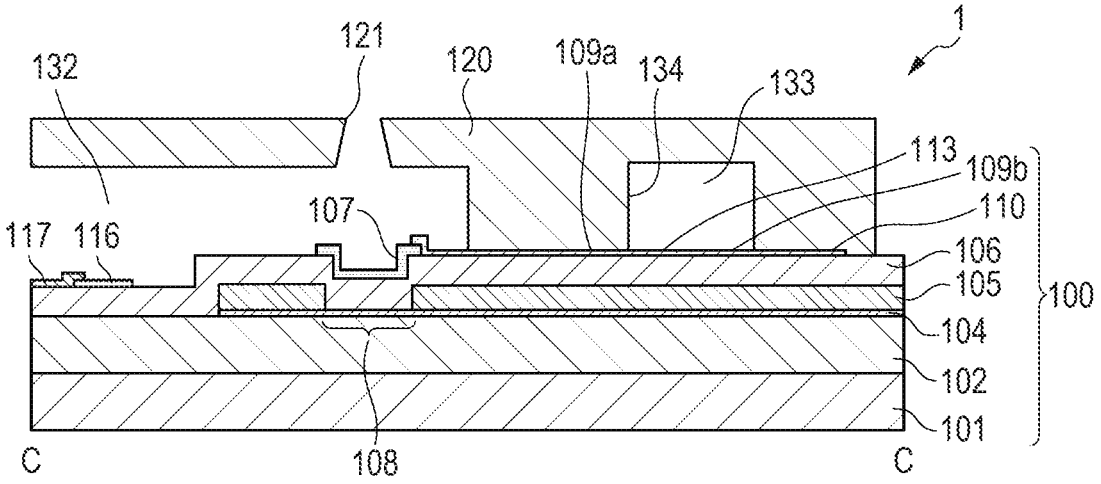
FIG. 10 is a sectional view of the ink jet head according to the third embodiment.

FIG. 9 is a plan view schematically illustrating a region including the heating resistance element 108 and the fuse part 113 of the ink jet head 1 according to a third embodiment. In addition, FIG. 10 illustrates a section of the ink jet head 1 taken along line C-C in FIG. 9.

In the embodiment, the upper protective layer 107 is formed of a material, that is, the platinum group such as iridium (Ir) or ruthenium (Ru) that is eluted in a liquid by the electrochemical reaction. In addition, the upper protective layer 107 is configured to be an anode to which a voltage can be applied from the outside via the individual wirings 109, the fuse part 113, and the common wiring 110. In addition, a counter electrode 116, which becomes a cathode electrode, is disposed at a certain distance from the upper protective layer 107 in the liquid chamber 132, and thus the counter electrode 116 is electrically connected by a wiring layer 117.

The upper protective layer 107 and the counter electrode 116 are not electrically connected to each other in a case where a liquid is not present in the liquid chamber 132. However, when the liquid chamber 132 is filled with a solution containing electrolytes, and the voltage is applied such that the upper protective layer 107 becomes the anode and the counter electrode 116 becomes the cathode, the electrochemical reaction occurs on an interface between the upper protective layer and the solution, and the upper protective layer 107 as the anode side is eluted in the liquid. Consequently, it is possible to remove the burnt deposits attached to a surface of the upper protective layer 107 that functions as the heat acting portion.

The liquid in the liquid chamber 132, which is used when the burnt deposits are removed, may be any liquid as long as the liquid is a solution such as ink that contains electrolytes. In addition, in the embodiment, the counter electrode 116, which becomes the cathode electrode when the electrochemical reaction is performed, is made of the same material as that of the upper protective layer 107. In other words, the counter electrode 116 is also formed by using Ir or Ru. However, as long as it is possible to achieve a preferred electrochemical reaction via the solution, the counter electrode may be formed of another material.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-030194, filed Feb. 22, 2018, which is hereby incorporated by reference herein in its entirety.

What is claimed is:

1. A liquid ejection head comprising:

a substrate for the liquid ejection head that includes, a base that is provided with a surface on which a first heating resistance element and a second heating resistance element that generate heat for ejecting a liquid are provided, a first covering portion that has conductivity and covers the first heating resistance element, a second covering portion that has conductivity and covers the second heating resistance element, an insulating layer that is disposed between the first heating resistance element and the first covering portion and between the second heating resistance element and the second covering portion, a fuse part that is cut due to heat generation, the fuse part being provided on a side of the base on which the first covering portion is provided, and a common wiring that is electrically connected to the first covering portion and the second covering portion and is coupled with the first covering portion via the fuse part; and a flow path forming member that is provided on a side of the first covering portion of the substrate for the liquid ejection head and has a wall which forms a flow path, wherein the flow path forming member is provided with a through-opening or a concave portion that is concave from a surface of the flow path forming member on a side of the substrate for the liquid ejection head, at a position that overlaps at least a part of the fuse part when viewed in a direction orthogonal to the surface.

2. The liquid ejection head according to claim 1, wherein the fuse part is a first fuse part, wherein the substrate for the liquid ejection head has a second fuse part that is cut due to heat generation, the second fuse part being provided on a side of the base on which the second covering portion is provided, wherein the common wiring is coupled with the second covering portion via the second fuse part, and wherein the concave portion or the through-opening overlaps at least a part of each of the first fuse part and the second fuse part when viewed in the orthogonal direction.

3. The liquid ejection head according to claim 1, wherein the fuse part is provided with a portion that is exposed through the concave portion or the through-opening.

4. The liquid ejection head according to claim 1, wherein the substrate for the liquid ejection head has a film that covers the fuse part.

5. The liquid ejection head according to claim 1, wherein the flow path forming member is provided with the concave portion.

6. The liquid ejection head according to claim 5, wherein a space surrounded by the concave portion and the substrate for the liquid ejection head contains a gas.

7. The liquid ejection head according to claim 5, wherein the flow path and the concave portion have substantially the same length in the orthogonal direction.

8. The liquid ejection head according to claim 1, wherein the entire fuse part is positioned on an inner side of the concave portion or the through-opening when viewed in the orthogonal direction.

9. The liquid ejection head according to claim 1, wherein the substrate for the liquid ejection head has a third heating resistance element provided at a position that overlaps the fuse part when viewed in the orthogonal direction and a wiring that electrically connects the third heating resistance element and a portion between the first covering portion and the fuse part, to each other.

10. The liquid ejection head according to claim 1, wherein the fuse part is a first fuse part, wherein the substrate for the liquid ejection head has a second fuse part that is cut due to heat generation, the second fuse part being provided on a side of the base on which the second covering portion is provided, wherein the common wiring is coupled with the second covering portion via the second fuse part, wherein the through-opening or the concave portion is a first through-opening or a first concave portion, wherein the flow path forming member is provided with a second through-opening or a second concave portion that overlaps at least a part of the second fuse part when viewed in a direction orthogonal to the surface.

* * * * *